United States Patent [19]

Meheen

[11] Patent Number: 4,914,887

[45] Date of Patent: Apr. 10, 1990

[54] METHOD AND APPARATUS FOR ANCHORING BACKFILLED WALL STRUCTURES

[76] Inventor: H. Joe Meheen, 1250 Humboldt - Apt. 1004, Denver, Colo. 80218

[21] Appl. No.: 282,597

[22] Filed: Dec. 12, 1988

[51] Int. Cl.[4] ..... E04B 1/02

[52] U.S. Cl. ..... 52/565; 405/262

[58] Field of Search ..... 52/565, 585, 586, 587, 52/593, 595, 299; 405/262, 273, 275, 281, 284, 285, 286; 256/19, 24, 31, 35, 73

[56] References Cited

U.S. PATENT DOCUMENTS

| | | | |
|---|---|---|---|
| 4,050,254 | 9/1977 | Meheen et al. | 405/285 |
| 4,341,491 | 7/1982 | Neumann | 405/262 X |
| 4,661,023 | 4/1987 | Hilfiker | 405/262 |
| 4,707,962 | 11/1987 | Meheen | 52/565 |

*Primary Examiner*—David A. Scherbel
*Assistant Examiner*—Creighton Smith
*Attorney, Agent, or Firm*—Edwin L. Spangler, Jr.; Richard W. Hanes

[57] ABSTRACT

A subassembly for use with a wall panel to retain a backfilled enbankment or the like is disclosed which subassembly comprises a pair of pillar-like concrete anchor members having vertical keyslots formed therein which receive and lock onto the enlarged end portions of a wire mesh web defining the connection therebetween. The top strand of the web is recessed beneath the top surface of any e xposed anchor member by a distance selected to permit backfilling thereabove as is the top surface of any buried anchor member. In one embodiment of the invention, the web is generally U-shaped and is looped through the embankment to interconnect a pair of exposed anchor members at the surface thereof while in another an exposed and a buried anchor member are interconnected by a straight run of the web stretched therebetween. The invention also encompasses the improved method for retaining backfilled earthen embankments which consists of placing a pair of pillar-like upstanding anchor members at an exposed surface of the embankment in transversely-spaced substantially parallel relation to one another, connecting the pair thus exposed to one another by means of a vertically-disposed wire mesh looped through the embankment or, alternatively, connecting each of the anchor members thus exposed independently to a third anchor member buried in the embankment by means of a straight run of wire mesh web stretched therebetween, and then interconnecting the transversely-spaced pair of exposed anchor members by bridging the gap therebetween with a wall panel.

10 Claims, 3 Drawing Sheets

METHOD AND APPARATUS FOR ANCHORING BACKFILLED WALL STRUCTURES

BACKGROUND OF THE INVENTION

1. Field of the Invention

In my U.S. Pat. No. 4,707,962 I disclosed an anchoring system for so-called "cascade" wall structures and the like consisting primarily of a pair of anchor members of more or less "dumbbell-shaped" cross section each having a web section terminating at both ends in an integrally-formed rib or flange and a generally arcuate bridging member, the opposite ends of which lock in behind a transversely-spaced pair of the anchor member flanges while the webs and remaining flanges of the latter are embedded in the soil forming the embankment or wall which must be confined. While this system is far superior in most respects to other prior art systems for the same purpose, it does have certain shortcomings which have proven to be somewhat troublesome and limit its utility, especially in certain applications.

To begin with, the anchor members are quite large, heavy and very difficult for one person to handle. This fact alone creates alignment problems, makes them difficult to stack and store, and they provide no versatility in terms of the distance separating the flanges which is fixed despite the fact that many applications exist in the field in where this spacing is far from ideal.

The flush arrangement of the web and buried portion of the anchor with respect to the top of the embankment creates compaction problems in that heavy equipment cannot be used for backfilling and the contractor is essentially forced to do it by hand. Also, being fabricated of concrete, even reinforced concrete, the tension loads that the web is capable of safely withstanding is somewhat limited.

Furthermore, inasmuch as the web comprises an integral part of the anchor member, auxiliary rods and pipes must be used to align and maintain the flanges in vertically-stacked relation where required.

2. Description of the Related Art

The most pertinent prior art known to me is found in my U.S. patent mentioned above although I have another Pat. No. 4,050,254 which pertains generally to the subject of tied-back retaining wall structures but ones of considerably different construction.

Of the prior art cited in my earlier patent discussed above, I consider to Knight the U.S. Pat. No. 1,847,655 and the German Pat. No. 812463 to be worth noting in terms of the evolution of the art of modular retaining wall structures and because they include certain specific features which I, too, incorporate into my anchoring system. Knight, for example, discloses a wall-forming module having oppositely-facing keyslots in its ends which, upon being placed in opposed face-to-face relation with the keyslot in another such module overlapping the latter, can be connected together by means of a key to form an essentially water-tight joint. This patent, however, includes no tie-back feature by means of which the modules are anchored to the soil nor is one needed since the function of the wall thus formed is not that of a retaining wall at all but rather a piling to be driven into the ground and, therefore, it is already supported both front and back and requires no additional anchoring.

In the German patent, on the other hand, a retaining wall structure is shown in FIGS. 2 and 3 wherein opposed pairs of post-like members are connected together by some sort of anchoring member h and adjacent pairs of these posts are bridged by arcuate panels not unlike those of my earlier patent to form a retaining wall. The posts are devoid of keyslots and there is no suggestion that the anchoring members h could be wire mesh nor is any way shown or suggested for connecting these anchoring elements to the posts. Moreover, nothing in this patent suggests the novel feature of using the mesh in vertically-disposed relation as the sole anchoring member requiring no second post on the other end thereof.

SUMMARY OF THE INVENTION

I have now found that the aforementioned shortcomings of my patented retaining wall system can be overcome by the simple, yet unobvious, expedient of eliminating the integrally-formed concrete web altogether, providing the anchor-forming endpieces which remain with vertically-extending keyslots, and tying back these anchors into the embankment individually or, alternatively, a pair of them to one another in side-by-side spaced apart relation by means of either straight or generally U-shaped lengths of wire mesh having at least one end formed and enlarged to define a retaining member connectable to one of these anchors by sliding same down into the keyslot. The resulting wire mesh web can be fabricated of any length necessary to suit a particular application and it has the additional advantage of being able to accommodate much greater tension loads than a concrete one, even when reinforced with steel. This means that much higher retaining walls can be constructed without the stepped-back configuration required of my earlier anchoring system.

Another very important advantage is that the wire mesh web when in place will be vertical, not horizontal as was the case with the Geomesh mats imbedded in the embankment behind the anchoring elements of my earlier patent. This means, of course, that a pair of anchor-forming endpieces can be tied together in side-by-side spaced apart relation by using a generally U-shaped length of wire mesh or the like moving from the face of the embankment where one of the anchors is located back into the interior thereof and out again to connect with the second anchor of the pair. When used in a free-standing wall structure, a straight length of mesh will connect a pair of anchors on opposite faces of the wall as was the case with the integrally-formed concrete one; however, the important difference is that the thickness of the wall can be varied at will by lengthening or shortening the web.

Among the other advantages is the fact that by having the two paired anchor-forming endpieces independent of one another, one can be buried and recessed beneath the surface along with the wire mesh web connecting it to its companion flange on the outside of the embankment thus permitting heavy motorized equipment to be used to compact the fill material placed thereabove without danger of its being damaged. Also, by recessing the wire mesh web at the top of each endpiece, its retaining member can be made to project beyond the keyslot at the lower end of the latter thus providing a self-aligning coupling to a second endpiece underneath without having to use special alignment rods or sleeves for this purpose. By extending the vertically-extending web back through and beyond the so-called "shear plane", instances of what is known as "slip circle failure" can be avoided.

The other very obvious advantages have to do with the greater ease with which the components of my latest system can be handled, shipped, stored and otherwise manipulated.

Accordingly, it is the principal object of the present invention to provide a novel and improved system for erecting retaining walls of one type or another together with the unique method of using same.

A second objective is to provide a system of the type described wherein a set of four interlocking components, two of which are identical, cooperate with one another in assembled relation to produce a much more versatile and effective way of building a retaining wall than that which has been available heretofore.

Another object of the within-described invention is to provide a wall panel for bridging the gap between adjacent anchor-forming endpieces that is susceptible of various decorative and ornamental treatments while, at the same time, retaining the structural integrity necessary as a component of the assembly used to contain and retain the earthworks.

An additional objective of the invention herein disclosed and claimed is to provide a simplified retaining wall erection system which requires no skilled labor, little if any motorized equipment, and one that can be erected easily and safely by one person.

Additional objects are to provide a combination of individual components for use in erecting a retaining wall which are relatively lightweight yet strong, easy to use, compact, safe, modular and highly decorative.

Other objects will be in part apparent and in part pointed out specifically hereinafter in connection with the description of the drawings which follows.

DESCRIPTION OF THE PREFERRED EMBODIMENTS

Figure 1:
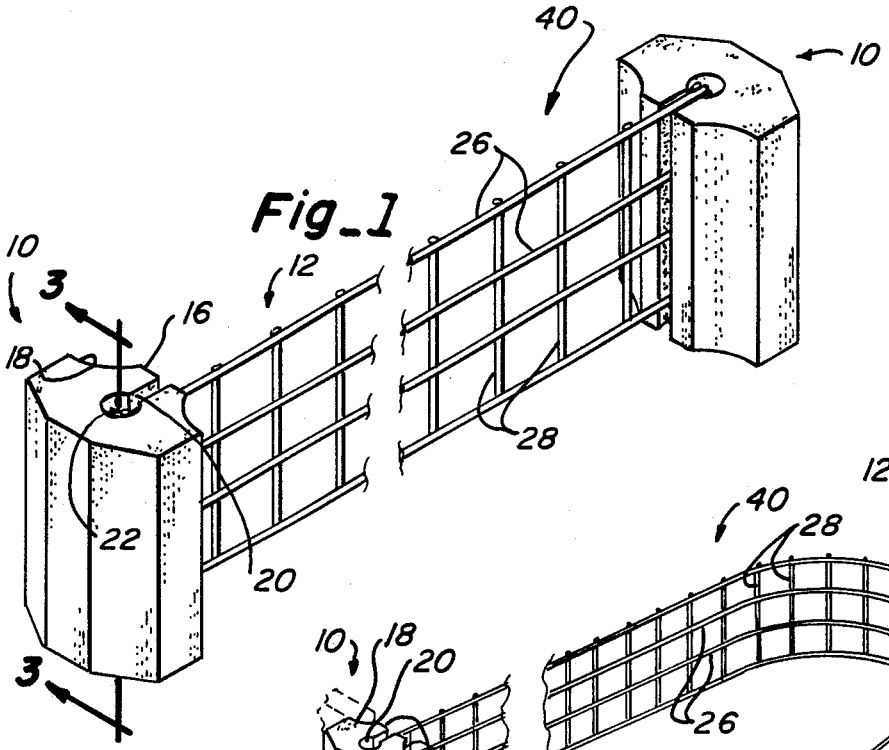
FIG. 1 is a perspective view, portions of which have been broken away to conserve space, showing a spaced apart pair of the keyslotted anchor-forming endpieces and a straight length of the wire mesh web interconnecting the latter into assembled relation by means of the enlargements formed on the ends thereof that define retaining ribs.

Referring next to the drawings for a detailed description of the retaining wall forming system of the present invention and the method of using same, it will be seen to comprise basically four elements of an assembly, two of which are identical. Specifically, these elements comprise what will be denominated here as "anchor-forming endpieces" or just "endpieces", a wire mesh web and a wall panel, the three having been referred to in a general way by reference numerals 10, 12 and 14, respectively. When a pair of the anchor-forming endpieces 10 are interconnected as shown in FIG. 1 by the wire mesh web 12, the resulting subassembly takes on the general shape of a dumbbell in cross section. The anchoring elements of my earlier U.S. Pat. No. 4,707,962 had this generally dumbbell-shaped cross section; however, the web-forming portion was considerably thicker, heavier and, most important, was formed integral with the flange-forming endpieces; whereas, the I-beam shaped subassembly of my present system consists of three separate interlocking pieces 10 and 12 which greatly facilitate the handling thereof as well as increasing its versatility as will become apparent as the description proceeds.

Endpieces 10, in the particular form shown, have the same general cross-section as the flange-forming elements on opposite ends of the anchor members of my earlier system except for the fact that the portions 16 thereof on the inner face that separate the generally concave seats 18 which receive the rounded panel ends are each provided with a vertically-extending keyslot 20. These keyslots together with the aforementioned seats comprise the main functional surfaces of the endpieces 10, the remaining exposed surfaces being shaped primarily for decorative reasons. In simple terms, these endpieces comprise short, keyslotted precast concrete pillars of sufficient breadth to anchor the web 12 when attached thereto and buried beneath the ground. As such, their function remains the same as it was in my earlier patented system. These anchor-forming endpieces in the particular form shown comprise a one piece pillar, however, two or more such endpieces can, if desired, be stacked one atop another with all being bridged and interconnected by a single length of webbing.

The prime area of novelty in my improved system forming the subject matter hereof lies in the wire mesh web, the formation of the enlarged retaining rib indicated in a general way by reference numeral 22 on the ends thereof, and the manner of connecting these enlarged ribbed ends into the keyslots in the anchor-forming endpieces. As can be seen most clearly in FIG. 4, one form of retaining rib 22 comprises welding a pair of vertical rods 24 to opposite sides of the horizontally-disposed strands 26 of steel wire mesh which, together with the vertically-extending strands 28 located at intervals intermediate the ribbed ends thereof define the so-called "ladder-type" wire mesh web seen in FIGS. 1–7, inclusive.

Figure 4:
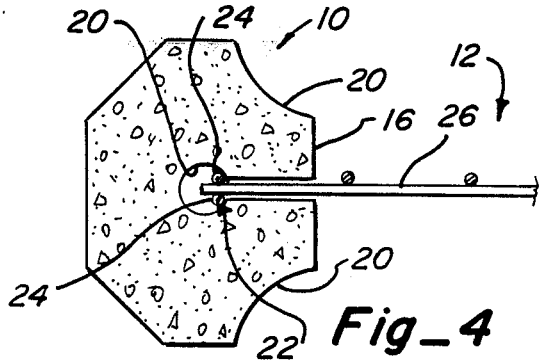
FIG. 4 is a fragmentary section taken along line 4—4 of FIG. 3.
Figure 7:
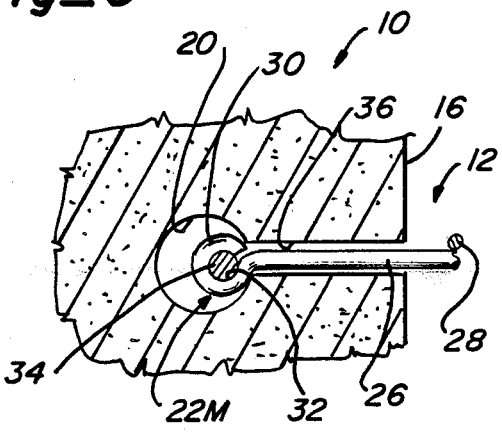
FIG. 7 is a still further enlarged fragmentary section similar to FIG. 4 but showing a modified retaining rib on an end of the wire mesh web.

An alternative form of an enlarged end portion defining a retaining member for insertion into the keyslot in place of the rib 22 shown in FIG. 4 is shown in FIG. 7 and it has been broadly designated by reference numeral 22M. Instead of a vertically-extending rib encompassing the full height of the web 12, it will be seen to comprise an integrally-formed loop 30 in the ends of the horizontally-disposed wires 26M of the web through the vertically-aligned openings 32 in which is passed a wire or rod 34 which cooperates with the loop encircling same to produce a series of vertically-spaced enlargements. The crosswise dimension of both rib 22 and enlargement 22M is, of course, greater than the width of the entrance 36 of the keyslot 20. For applications where maximum strength is required, the FIG. 4 ribbed version is somewhat preferable to the alternative looped-wire version shown in FIG. 7 because the latter has less bearing surface in contact with the keyslot than the ribbed one. On the other hand, the looped-wire version is easier and less labor-intensive to fabricate.

Figure 10:
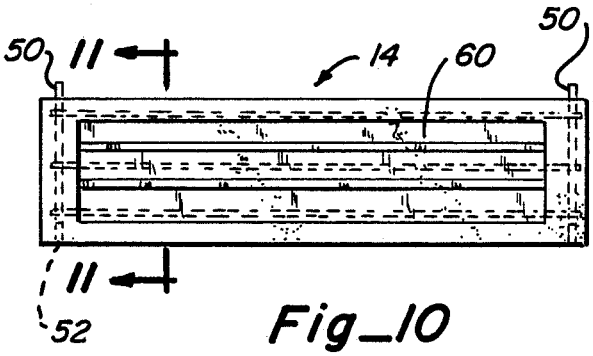
FIG. 10 is a front elevation showing the decorative face of one of the steel-reinforced panels which are used to span the gap between adjacent anchor-forming endpieces.

A brief look at FIG. 10 will reveal an alternative form of web 12M in which instead of the horizontally-disposed wires 26 being interconnected by vertically-oriented ones to define a ladder-like construction, a zig-zag wire pattern 38 interconnects the horizontal ones to produce a truss-like web.

Of considerably more importance than the pattern of the wire mesh web or, for that matter, the particular form of the enlargement on the ends thereof that locks it into the keyslot 20, is the manner in which the subassembly is used which consists of a pair of these endpieces and the web interconnecting same, which subassembly has been broadly identified in the drawings by reference numeral 40. Particular reference will now be made to FIGS. 1–3, 5, 6 and 8 for a detailed description of the manner of using this subassembly which in most respects differs significantly from the way the anchor members of my earlier system were used.

Figure 2:
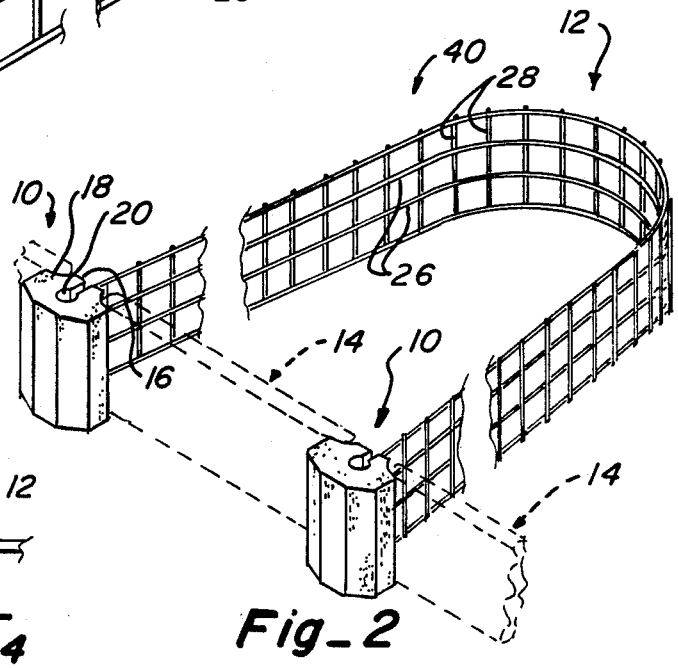
FIG. 2 is a perspective view similar to FIG. 1 but to a smaller scale, again with portions broken away to conserve space, showing side-by-side pair of the anchor-forming endpieces interconnected by a generally U-shaped span of web-forming wire mesh.
Figure 3:
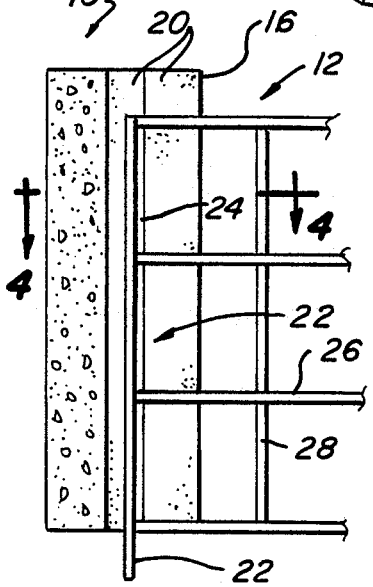
FIG. 3 is a fragmentary section to a greatly enlarged scale taken along line 3—3 of FIG. 1.
Figure 5:
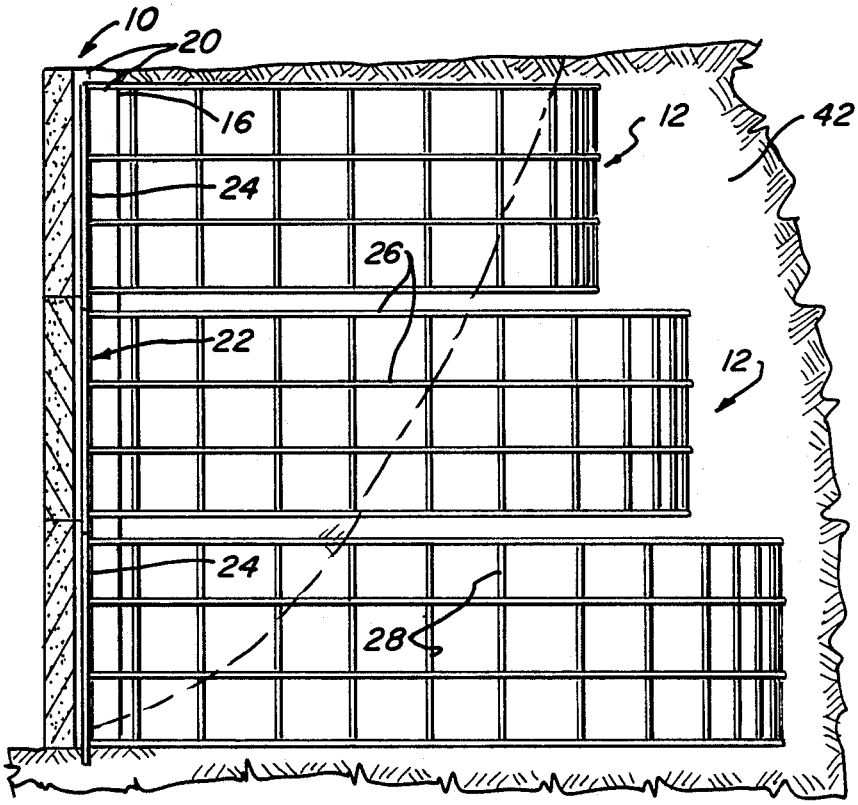
FIG. 5 is a fragmentary vertical section showing a multi-tiered retaining wall with no stepback and with the enlargements at the end of the wire mesh webs being employed to align the anchor-forming endpieces vertically.

Commencing with FIGS. 1 and 2, the simplest form of the subassembly 40 is the one in which a straight section of wire mesh web is used to interconnect the pair of anchor-forming endpieces 10. In the particular form shown in these two figures, it will be noted that the lefthand end of the web is recessed within the keyslot in the endpiece, whereas, the top of the web is flush with the top of the righthand endpiece. In a setup like this one, the lefthand endpiece is left exposed on the face of the embankment 42 in the manner shown in FIG. 5 while the righthand one is buried beneath the surface of the latter. With the righthand endpiece and the top of the web buried beneath the surface of the embankment, heavy motorized backfilling equipment (not shown) can be used to compact the fill material working back and forth over the top of the latter. By way of contrast, in the wall structure shown in FIG. 8 where both of the endpieces are exposed, the web is recessed beneath the top surface of each one while, at the same time, permitting compaction to be carried out therebetween. In both the embodiments of FIG. 1 and FIG. 8, of course, the length of the web 12 can be varied to suit the particular retaining problem found to exist at the site. In FIG. 5, for example, the web, be it straight as in FIGS. 1 and 8, or U-shaped as in FIGS. 2 and 5, can be extended well behind the failure plane represented by the dashed line. In my earlier system, the anchoring elements themselves were only of a given length and any extension of the system to encompass a failure plane like the one shown in FIG. 5 necessitated the use of Geomesh laid flat between courses as each tier was put in place one atop the other.

Figure 8:
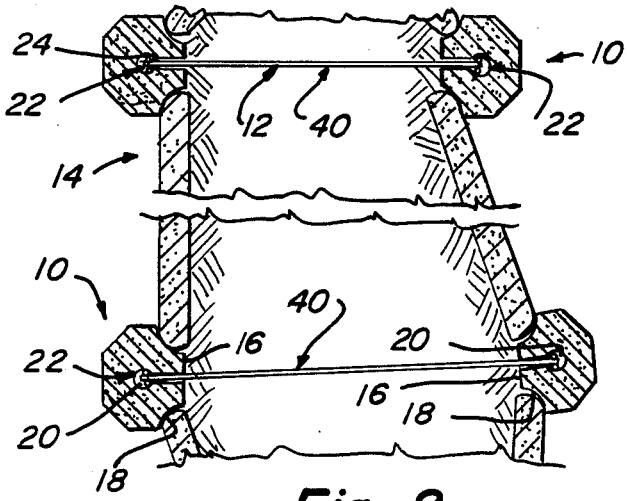
FIG. 8 is a fragmentary horizontal section showing how the system is used to confine both faces of a dirt-filled wall.
Figure 9:
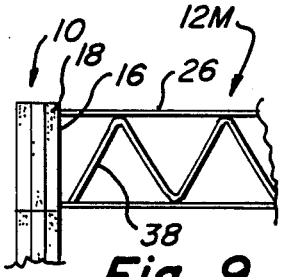
FIG. 9 is a fragmentary vertical section similar to FIG. 3 but to a much smaller scale showing a truss-type wire web as an alternative to the ladder-type shown in the other figures.

Before leaving FIGS. 1 and 8 it should, perhaps, be pointed out that the system shown therein differs significantly from my previously patented system and also from that disclosed in German Pat. No. 812 463 in that the Geomesh itself is the only anchoring element required and it need not, therefore, be used as a bridging element between a pair of anchor posts as both of these patents show. In other words, the Geomesh anchors of FIGS. 1 and 8 could be split vertically at some point between the ends thereof such that one section anchored one post and the remaining section the other or, alternatively, the mesh sections could overlap one another without being connected together in any way. From a practical standpoint, of course, a single length of mesh of the proper length simplifies installation even though the bridged connection between posts is unnecessary.

Directing the attention to FIGS. 2 and 5, an alternative form of the subassembly 40 is shown in which both of the endpieces 10 lie in transversely-spaced exposed relation on the surface of the embankment while the web 12 is U-shaped to interconnect the two after passing into the embankment and back out again. Here again, the web can be recessed for compaction purposes, be made as long as necessary and, as seen in FIGS. 5 and 6, be used to form the interlock vertically aligning the tiers of endpieces thus eliminating the need for separate alignment pins and sleeves for this purpose.

FIG. 5 also shows a tiered retaining wall with no setbacks being required in the manner of a stepped so-called "cascade wall". Depending to some degree upon the particular soil conditions encountered, tiered walls containing three stacked three foot high tiers can be constructed without having to set back any of the tiers. This becomes possible because the web of each successively lower tier in the stack can be made longer as shown to resist the relatively greater loads imposed thereon from above. The U-shaped configuration seen in FIGS. 2 and 5 is preferred over one which is "squared off" primarily because of the simplicity of manufacture although there is little to recommend one over the other functionally and both can easily be made to nest.

Figure 6:
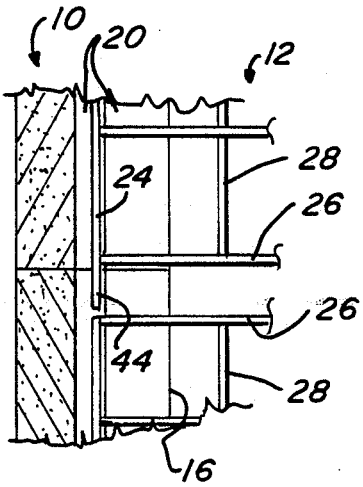
FIG. 6 is a further enlarged fragmentary sectional detail emphasizing the vertical alignment feature mentioned above in connection with FIG. 5.

With specific reference to FIG. 6, a bit more should, perhaps, be said concerning the interlocking feature of the webs 12. As shown, the wires or rods 26 or, alternatively, the single one 32 that goes down through the looped-wire ends 30 in the modification 22M of FIG. 7 are preferably both left flush with the top horizontally-disposed strand 26 of the mesh while allowed to project at least an inch or so below the lowermost horizontal strand thereof. By so doing, this projecting portion 44 will enter the unobstructed upper end of the keyslot in the endpiece therebeneath thus forming an alignment connection therebetween. In the lowercost of several tiers, this projection 44 will merely stick down into the ground below the bottom of the endpiece. In that rare circumstance where this projection would cause a problem, it can either be cut off or the web turned upside down in which the bottom strand of the mesh would be at the top and recessed while the top strand at the bottom would be flush with the bottom of the endpiece. For maximum versatility, therefore, the length of the rib-forming wires 24 or the centerwire 32 should roughly correspond to the overall height of the endpieces while the vertical distance separating the top and bottom strands of the web should be less than the overall height of the endpiece by the length of the projection 44.

Directing the attention briefly to FIGS. 10–13, inclusive, certain features of the bridging panel 14 which comprises the fourth element of the assembly will be described in detail along with the method by which it is fabricated. It, like the ones in my earlier system is precast out of concrete. The most obvious difference, of course, is that the earlier one was curved while the one illustrated herein is flat. Both have the exposed side edges 46 curved to seat within the complementary curved concave seats 18 of the endpieces as shown most clearly in FIG. 8.

Figure 13:
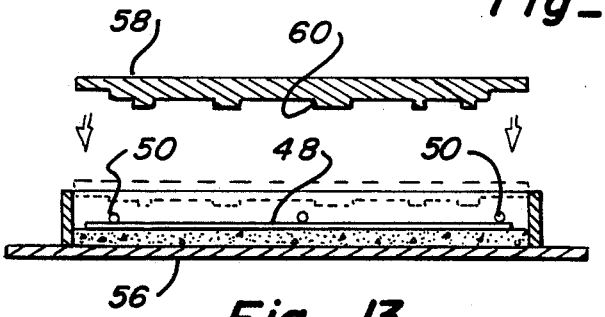
Figure 12:
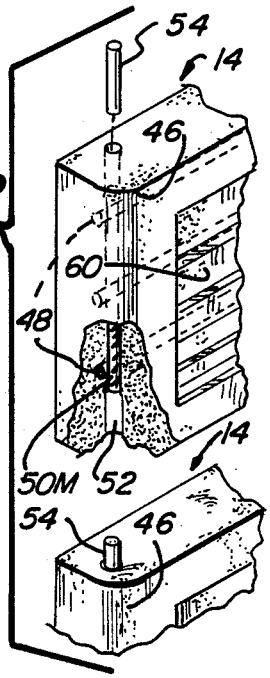
FIG. 12 is an exploded view showing one way in which these panels can be held in vertically-aligned relation using alignment pins; and, FIG. 13 illustrates the manner in which the panels are poured in two steps.
Figure 11:
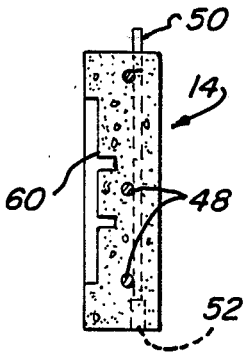
FIG. 11 is a section to an enlarged scale taken along line 11—11 of FIG. 10.

Steel reinforcing rods 48 and 50 are embedded in the concrete and may take the form shown in FIGS. 10, 11 and 13, some (48) extending horizontally while others (50) extend vertically. The vertically extending ones, particularly those at opposite ends of the panel can be used advantageously as alignment pins by letting them project as shown either above or below the adjacent panel surface from which they emerge. Suitable sockets 52 must, of course, be provided in the mating surface of the companion panel in the stack. An alternative construction might be one shown in FIG. 12 in which the vertically-extending rod 50M is foreshortened to leave sockets at both ends as shown in FIG. 12 in which case a separate alignment pin 54 would be used. No attempt has been made to describe how these sockets 52 might be formed since such procedures are well within the skill of the ordinary artisan and for this reason form no part of the present invention. As a matter of fact, by welding short sleeves (not shown) to one or both ends of the vertically-extending rebar pieces at opposite ends of the panel, formation of the sockets 52 takes care of itself.

Finally, with reference to FIG. 13, one method of forming the panels in order to provide a decorative face thereon will be described briefly. First, a shallow pan-type mold 56 consisting of a pallet 56P and an open-bottomed frame 56F is partially filled with wet zero-slump concrete and before it sets, the rebar (48, 50) is laid in place atop the layer just formed and a second layer poured on top. Next, a lid 58 containing suitable decoration 60 which is to appear on the face of the panel is pressed down atop the second layer, vibrated and left in place until the assembly hardens. Finally, the lid is raised and the finished panel removed from the pallet along with the mold which is then stripped therefrom.

What is claimed is:

1. An anchor subassembly for use with a wall panel to define a retaining wall for a backfilled embankment and the like which comprises: means defining a pair of short pillar-like concrete endpieces each of which has a front face and a rear face, a vertically-extending keyslot having an entrance thereto opening onto the rear face thereof and a pair of seats in said rear face disposed on opposite sides of said keyslot positioned and adapted to receive and retain complementary shaped front corners on the side margins of a generally rectangular wall panel bridging the gap between two of said endpieces arranged in transversely-spaced substantially parallel relation; and, a wire mesh web having top and bottom strands spaced apart vertically a distance no greater than the height of said endpieces and opposite end portions adapted to be received in the entrances to said keyslots, and means carried by said end portions defining vertically-disposed longitudinally-spaced parallel enlargements sized for insertion and retention within said keyslots, said web when buried in a backfilled embankment cooperating with endpieces attached to the enlarged ends thereof to anchor at least one of said endpieces in embankment-supporting relation on the exposed surface thereof, and a transversely-spaced substantially parallel pair of said anchored embankment-supporting endpieces cooperating with one another and with a wall panel bridging the gap therebetween to define a retaining wall.

2. The anchor subassembly as set forth in claim 1 in which: the endpieces have top and bottom surfaces shaped to mate in stacked relation; and, in which the top strand of the web is spaced beneath the top of at least one of the endpieces in the subassembly a distance selected to permit backfilling thereabove to the level of the top of said one endpiece.

3. The anchor subassembly as set forth in claim 1 in which: the endpieces have top and bottom surfaces shaped to mate in stacked relation; and, in which the means on the ends of the web defining the enlargements are of a length selected to project beneath the bottom surface of a superimposed endpiece a distance effective to enter the keyslot in the top of a second endpiece therebeneath and interconnect same in aligned and vertically-stacked relation.

4. The anchor subassembly as set forth in claim 1 wherein in those instances where the paired endpieces of the subassembly are both to be located on an exposed surface of the embankment being retained in transversely-spaced relation to one another: the web interconnecting said endpieces is generally U-shaped so as to extend rearwardly from one of said endpieces back into said embankment, across and forwardly out to the other.

5. The anchor subassembly as set forth in claim 1 wherein in those instances where one of the paired endpieces of the subassembly is to be located on an exposed surface of the embankment being retained and the other of said paired endpieces is to be buried therein: said endpieces both have top surfaces; said web extends in substantially straight-line relation between said paired endpieces; the top strand of said web is recessed beneath the top surface of said endpiece of the pair which is to be exposed a distance selected to permit backfilling thereabove; and the top of said endpiece of the pair which is to be buried is substantially flush with said top web strand.

6. The anchor subassembly as set forth in claim 1 wherein in those instances where both of the paired endpieces are to be exposed on oppositely-facing surfaces of an earthen wall: both of said paired endpieces have a top surface and the top strand of the web is recessed beneath the top surfaces of both of said endpieces which are to be exposed a distance selected to permit backfilling thereabove.

7. The anchor subassembly as set forth in claim 1 in which: the enlargements on the ends of the web comprise a pair of vertically-disposed wires welded to the top and bottom strands on opposite sides thereof.

8. The anchor subassembly as set forth in claim 1 in which: the enlargements on the ends of the web comprise loops formed in the ends of the top and bottom strands and a vertically-extending rod passes through said loops.

9. The anchor subassembly as set forth in claim 2 in which: the bottom strand of said web is substantially flush with the bottom surface of said one endpiece.

10. The anchor subassembly as set forth in claim 3 in which: the top strand of the web is recessed beneath the top surface of at least one of said endpieces a distance selected to permit backfilling thereabove.

* * * * *